US010571198B2

(12) United States Patent
Kane et al.

(10) Patent No.: US 10,571,198 B2
(45) Date of Patent: Feb. 25, 2020

(54) MULTI-CAVITY TUBES FOR AIR-OVER EVAPORATIVE HEAT EXCHANGER

(71) Applicant: Evapco, Inc., Taneytown, MD (US)

(72) Inventors: Jeffrey Kane, Biglerville, PA (US); Davey Joe Vadder, Westminster, MD (US)

(73) Assignee: Evapco, Inc., Taneytown, MD (US)

( * ) Notice: Subject to any disclaimer, the term of this patent is extended or adjusted under 35 U.S.C. 154(b) by 19 days.

(21) Appl. No.: 15/477,651

(22) Filed: Apr. 3, 2017

(65) Prior Publication Data

US 2017/0299272 A1 Oct. 19, 2017

Related U.S. Application Data

(60) Provisional application No. 62/316,654, filed on Apr. 1, 2016.

(51) Int. Cl.
*F28D 3/02* (2006.01)
*F28D 1/047* (2006.01)
(Continued)

(52) U.S. Cl.
CPC ..... *F28D 3/02* (2013.01); *F28C 1/14* (2013.01); *F28D 1/0478* (2013.01); *F28D 3/04* (2013.01);
(Continued)

(58) Field of Classification Search
CPC ..... F28F 1/02; F28F 1/06; F28F 1/08; F28F 2025/005; F28D 1/0478; F28D 3/02;
(Continued)

(56) References Cited

U.S. PATENT DOCUMENTS 910,192 A * 1/1909 Grouvelle, et al. ..... F28F 13/12 138/38
4,002,200 A * 1/1977 Raskin ..... F28D 1/0308 165/131
(Continued)

FOREIGN PATENT DOCUMENTS

CN 201740442 U 2/2011
DE 202007016841 2/2008
(Continued)

OTHER PUBLICATIONS

International Search Report issued in co-pending International Patent Application No. PCT/US17/25741 dated Sep. 8, 2017.
(Continued)

*Primary Examiner* — Stephen Hobson
(74) *Attorney, Agent, or Firm* — Whiteford, Taylor & Preston, LLP; Peter J. Davis

(57) ABSTRACT

An air-over evaporative heat exchanger with multi-lobed or "peanut" shaped tubes replacing conventional round or elliptical tubes. The tubes have a narrow horizontal cross section and tall vertical cross section to allow the multiplication of surface area in the same coil volume while maintaining or increasing the open-air passage area. This configuration allows the coil to have an overall external heat transfer coefficient much higher than a conventional coil, while the tube shape allows the use of thinner material, reducing the weight and cost of the heat exchanger.

7 Claims, 10 Drawing Sheets

(51) Int. Cl.

| | |
|---|---|
| ***F28C 1/14*** | (2006.01) |
| ***F28F 1/02*** | (2006.01) |
| ***F28D 3/04*** | (2006.01) |
| ***F28F 1/06*** | (2006.01) |
| *F28D 15/00* | (2006.01) |
| *F28D 21/00* | (2006.01) |
| *F28F 25/00* | (2006.01) |

(52) U.S. Cl.
CPC ..... *F28F 1/02* (2013.01); *F28F 1/06* (2013.01); *F28D 15/00* (2013.01); *F28D 2021/0063* (2013.01); *F28F 2025/005* (2013.01)

(58) Field of Classification Search
CPC .... F28D 3/04; F28D 15/00; F28D 2021/0063; F28C 1/14
See application file for complete search history.

(56) References Cited

U.S. PATENT DOCUMENTS 4,269,267 A * 5/1981 Labrande ..... B21C 37/22 165/181
4,422,501 A * 12/1983 Franklin ..... F28D 15/04 165/104.23
4,434,112 A * 2/1984 Pollock ..... F28D 5/02 165/170
4,693,302 A * 9/1987 Dodds ..... B01D 1/0047 165/111
4,755,331 A * 7/1988 Merrill ..... F28D 5/02 165/172
5,174,928 A * 12/1992 Cheng ..... B01J 10/02 165/115
5,839,505 A * 11/1998 Ludwig ..... F28D 1/0477 165/109.1
6,422,306 B1 * 7/2002 Tomlinson ..... F28D 1/035 165/170
6,820,685 B1 11/2004 Carter et al.
7,296,620 B2 * 11/2007 Bugler, III ..... F28D 1/0478 165/150
8,844,472 B2 * 9/2014 Smelcer ..... F24H 1/287 122/18.3
9,476,656 B2 * 10/2016 Anwar ..... F28F 13/12
9,885,513 B2 * 2/2018 Litch ..... F25B 39/02
2005/0045314 A1 * 3/2005 Elbourini ..... F28D 1/05366 165/152
2010/0012307 A1 * 1/2010 Taras ..... F28D 1/0471 165/177
2011/0146594 A1 6/2011 Smelcer
2012/0012292 A1 * 1/2012 Bugler, III ..... F28D 5/02 165/174
2012/0036718 A1 2/2012 Stroup et al.
2013/0299132 A1 * 11/2013 Guilford ..... F28F 1/00 165/67
2018/0023895 A1 * 1/2018 Kraft ..... F28D 1/0478 165/109.1
2018/0100701 A1 * 4/2018 Beaver ..... F28D 1/0478
2018/0142958 A1 * 5/2018 Hanganu ..... B01D 47/05

FOREIGN PATENT DOCUMENTS

| | | | |
|---|---|---|---|
| GB | 139176 | 5/1921 | |
| GB | 876040 | 8/1961 | |
| GB | 2039357 | 8/1980 | |
| WO | 2007082921 | 7/2007 | |
| WO | WO-2016170200 A1 * | 10/2016 | ..... B01D 47/05 |

OTHER PUBLICATIONS

Extended European Search Report issued in co-pending European application No. 17776907.2 dated Oct. 10, 2019.
Chinese Office Action issued in co-pending Chinese application No. 2017800222028 dated Nov. 13, 2019.

* cited by examiner

MULTI-CAVITY TUBES FOR AIR-OVER EVAPORATIVE HEAT EXCHANGER

BACKGROUND OF THE INVENTION

Field of the Invention

This invention relates to evaporative air-over heat exchangers.

Description of the Background

It is well known that elliptical tubes work well for evaporative heat exchangers. Increasing the heat exchanger tube density works well for systems that have no airflow over the coil, while increasing the external surface area using extended fins works well in systems that have airflow over the coil. However, both of these methods increase the weight of the heat exchanger coil and consequent cost per heat exchanger compared to conventional tube-coil designs since the tubes are required to have a minimum wall thickness to operate under internal pressure without deforming.

SUMMARY OF THE INVENTION

This invention serves to solve the problem of increased weight and cost with incremental improvements in capacity by improving the thermal capacity while decreasing the cost for equivalent thermal capacity with a special tube shape and pattern that increases the prime surface area in contact with the airstream thereby improving thermal capacity, at the same time decreasing the thickness of the heat exchanger tubes thereby decreasing the cost for equivalent thermal capacity. The effective diameter of the tube is reduced by the design of the invention, which allows the tube wall to be reduced in thickness for the same internal pressure. The open air face area to tube face area ratio determines to a large extent the effectiveness of the heat exchanger. If this ratio is too low, the heat exchanger will have an undesirable airside pressure drop, lowering its effectiveness in an evaporative heat exchanger. This effect is more pronounced in evaporative heat exchangers than in a dry air heat exchanger because of the water-air interaction. The tube shape and pattern of the invention serves to keep this ratio equal to or lower than conventional heat exchangers of the same volume (i.e., coil volume, that is, the volume defined by the outer dimensions of the coil, L×W×H) while increasing the surface area of the coils. The combination of increasing the coil surface area, reducing the tube wall thickness, and maintaining or decreasing the airside pressure drop using the new tube design of the invention serve to create a heat exchanger with superior thermal efficiency and cost effectiveness.

Therefore, there is provided according to various embodiments of the invention multi-lobed tubes that may be used in place of single round or elliptical-shaped tubes of prior art heat exchangers. These multi-lobed tubes are tall and narrow in vertical cross section. The multi-lobed tubes may have 2, 3, 4 or more lobes per tube. The multi-lobed shape allows the tubes to have a smaller air-face profile and thinner wall while maintaining the working pressure limit and outside surface area per tube. The narrow air-face profile also allows many more tubes to exist in the same heat exchanger volume while maintaining or decreasing the open air face area to tube face area ratio to maintain or decrease the airside pressure drop and maintain or increase the airflow volume per horsepower. Heat exchangers having the tube design of the present invention will work equally well as fluid coolers or refrigerant condensers.

Accordingly, there is presented according to an embodiment of the invention an air-over evaporative heat exchanger coil having multi-lobed tubes that have the same or higher surface area as a heat exchanger coil of the same size/volume with conventional round or elliptical tubes.

Accordingly, there is presented according to an embodiment of the invention an air-over evaporative heat exchanger coil having multi-lobed tubes that use much thinner tube walls than a conventional single tube of the same outside surface area.

Accordingly, there is presented according to an embodiment of the invention an air-over evaporative heat exchanger coil having an open air face area to tube face area ratio equivalent or greater than a conventional heat exchanger coil of the same size/volume with conventional round or elliptical tubes.

Accordingly, there is presented according to an embodiment of the invention an air-over evaporative heat exchanger coil having tube surface area significantly larger than a conventional heat exchanger coil of the same size/volume with conventional round or elliptical tubes.

Accordingly, there is presented according to an embodiment of the invention an air-over evaporative heat exchanger coil comprised of: a plurality of multi-lobed tubes arranged in a tube bundle.

There is further presented according to an embodiment of the invention an air-over evaporative heat exchanger coil with multi-lobed tube having exactly two lobes.

There is further presented according to an embodiment of the invention an air-over evaporative heat exchanger coil with multi-lobed tubes having exactly three lobes.

There is further presented according to an embodiment of the invention an air-over evaporative heat exchanger coil with multi-lobed tubes with 100%-300% of the tube surface area of a coil having the same external dimensions with 0.85 inch elliptical tubes.

There is further presented according to an embodiment of the invention an air-over evaporative heat exchanger coil with multi-lobed tubes with 25%-150% of the open-air passage area of a coil having the same external dimensions with 0.85 inch elliptical tubes.

There is further presented according to an embodiment of the invention an air-over evaporative heat exchanger coil with multi-lobed tubes wherein the major axis of the tube is tilted 0 to 25 degrees relative to vertical.

There is further presented according to an embodiment of the invention an evaporative heat exchanger for cooling or condensing a process fluid, comprising: an indirect heat exchange section; a water distribution system located above the indirect heat exchange section and configured to spray water over the indirect heat exchange section; wherein the indirect heat exchange section comprises a process fluid inlet header and a process fluid outlet header, and an array of tubes multi-lobed tubes connecting said inlet header and said outlet header, said tubes further having lengths extending along a longitudinal axis; the evaporative heat exchanger also including a plenum where water distributed by said water distribution system and having received heat from said indirect section is cooled by direct contact with air moving through said plenum; a water recirculation system, including pump and pipes, configured to take water collecting at the bottom of said plenum and deliver it to said water distribution system; and an air mover configured to move ambient air into said plenum and up through said indirect section.

There is further presented according to an embodiment of the invention, a heat exchange tube bundle in which the multi-lobed tubes are straight and are each connected at a first end to a process fluid inlet header and at a second end to a process fluid outlet header.

There is further presented according to an embodiment of the invention a heat exchange tube bundle in which the multi-lobed tubes are serpentine and each serpentine tube comprises a plurality of lengths connected at each end to adjacent lengths of the same serpentine tube by tube bends and connected at one end of a serpentine tube to a process fluid inlet header, and at a second end to a process fluid outlet header.

BRIEF DESCRIPTION OF THE DRAWINGS

The subsequent description of the preferred embodiments of the present invention refers to the attached drawings, wherein.

DETAILED DESCRIPTION OF THE INVENTION

Figure 1:
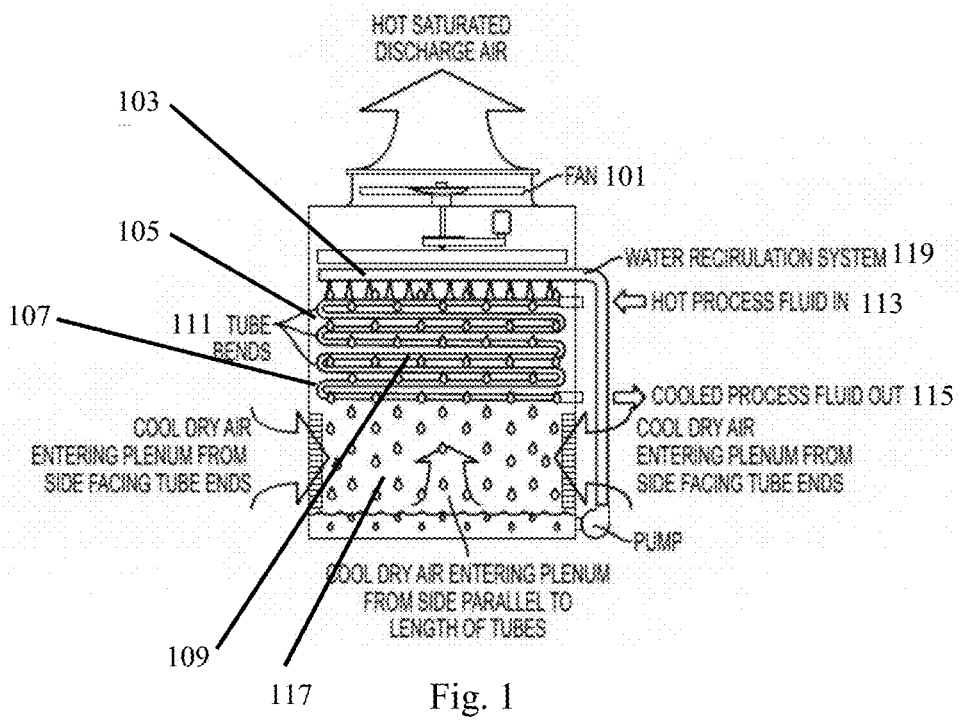
FIG. 1 is a cutaway side view of a prior art evaporative heat exchanger.
Figure 2:
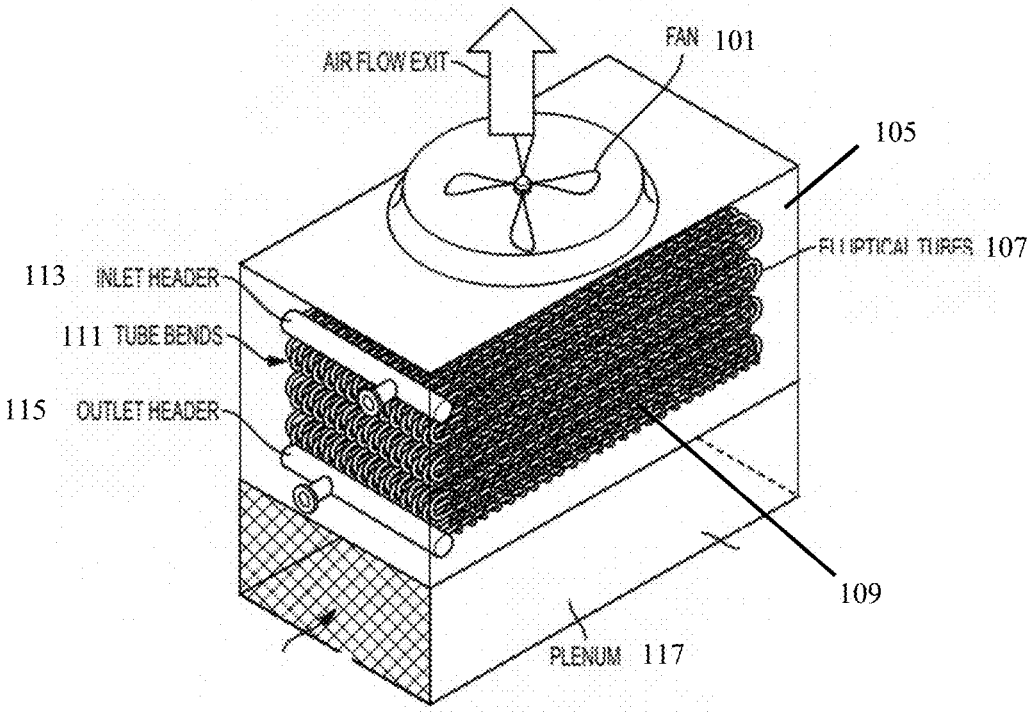
FIG. 2 is a cutaway perspective view of a prior art evaporative heat exchanger.

FIGS. 1 and 2 show an induced draft single cell evaporative cooler according to the prior art. Fan 101 draws air into the unit and forces it out the top of the unit. Below the fan is a water distribution system 103 that distributes water over the tube coil 105. The tube coil is made of an array of serpentine elliptical tubes 107. Each length of tube 109 is connected at its ends to an adjacent higher and/or lower tube length by a tube bend 111. Process fluid to be cooled enters the tubes via an inlet header 113 and exits the tubes via an outlet header 115. Beneath the tube coil is the plenum 117, where air enters the unit and the water that is delivered to the unit via the water distribution system 103 is cooled via direct heat exchange with the air, collects at the bottom and recirculated to the top via water recirculation system 119.

Figure 3:
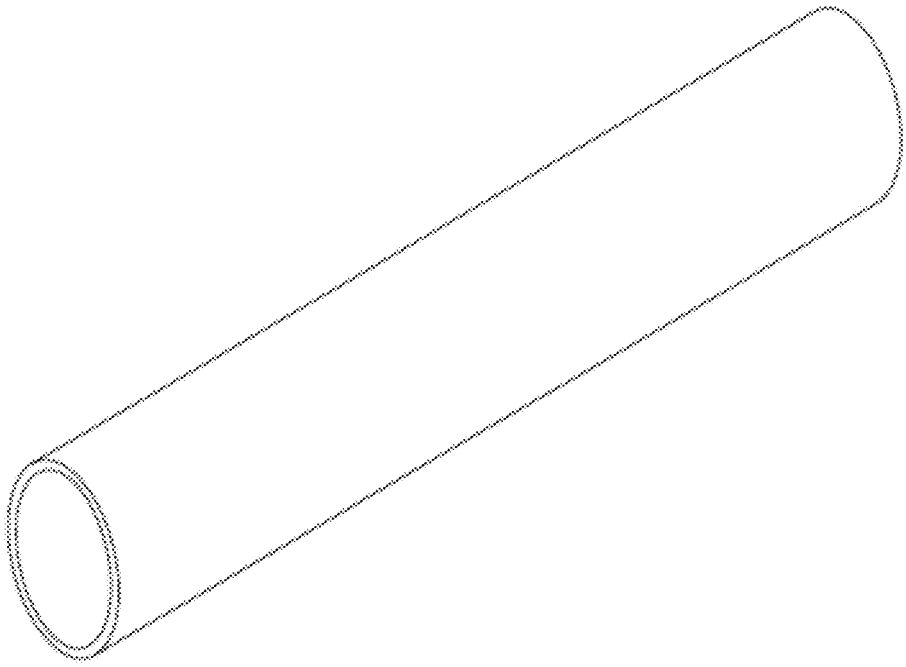
FIG. 3 shows an outside perspective view of a conventional prior art elliptical evaporative heat exchanger tube.
Figure 4:
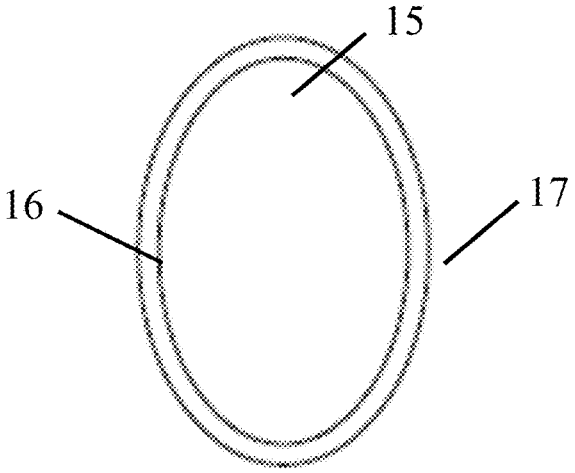
FIG. 4 shows a cross-sectional view of the conventional prior art elliptical evaporative heat exchanger tube of FIG. 3.
Figure 5:
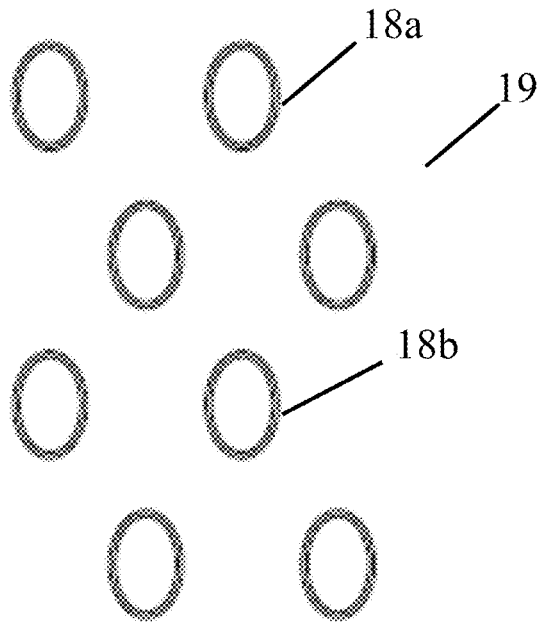
FIG. 5 is a representation of a cross-sectional view of a conventional prior art evaporative heat exchanger tube bundle having elliptical tubes.
Figure 6:
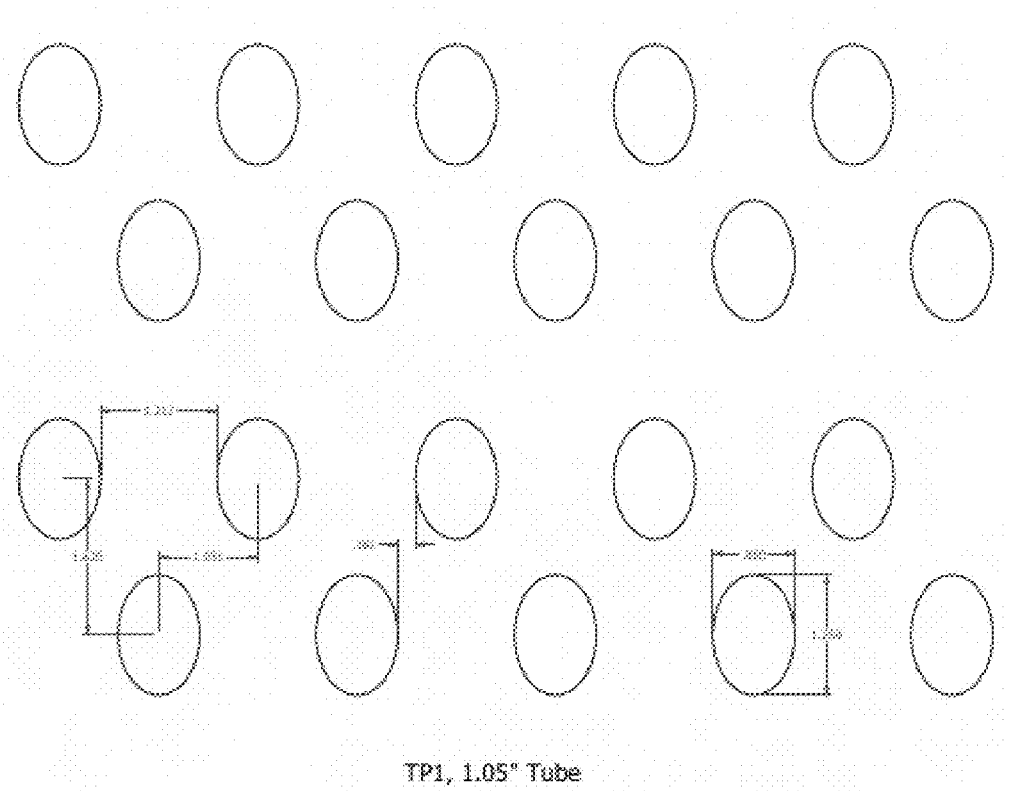
FIG. 6 is another representation of a cross-sectional view of a conventional prior art evaporative heat exchanger tube bundle having elliptical tubes.
Figure 7:
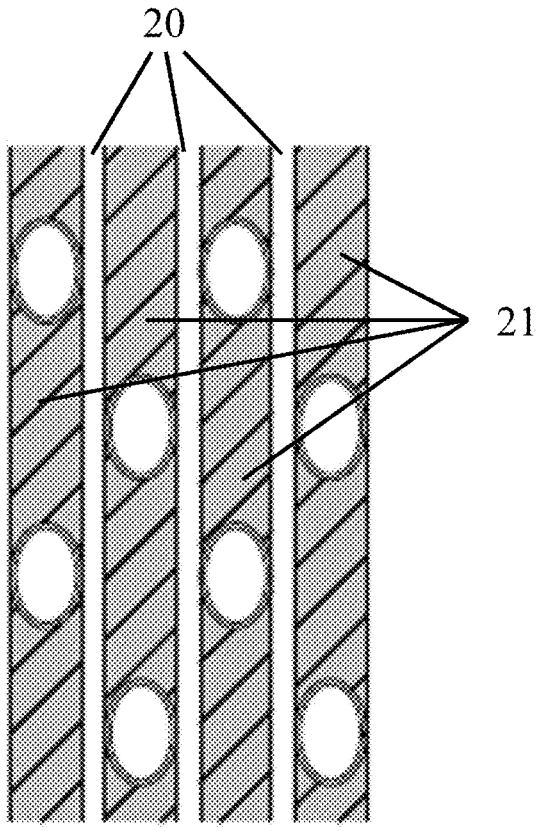
FIG. 7 is a graphical representation of the open air face area to tube face area for a conventional prior art evaporative heat exchanger tube bundle having elliptical tubes.

FIGS. 3 and 4 shows a conventional evaporative heat exchanger elliptical tube 107 of the type used in the prior art heat exchanger of FIGS. 1 and 2. A working fluid such as water, glycol, or ammonia 15 is contained within the tube wall 16. Water droplet-filled air 17 flows around the tube from bottom to top. FIGS. 5 and 6 show how a plurality of tubes of the type shown in FIGS. 3 and 4 are typically arranged in a tube bundle in a heat exchanger of FIGS. 1 and 2. Multiple tubes 18*a,b,* etc., are generally arranged in a patterned allow water droplet-filled air 19 to pass around the tubes under the force of gravity. The ratio of open air face area 20 to tube face area for this arrangement is shown in FIG. 7, according to standard tube sizing and spacing shown in FIG. 6. Tubes of this type are typically formed from round 1.05 inch diameter tubing having a tube wall thickness of 0.055 inches, which are then mechanically "squeezed" into an ellipse having a minor diameter of 0.850 inches. FIG. 7 shows graphical representation of the open air face area 20 to tube face area 21 for a standard evaporative heat exchanger tube bundle with elliptical tubes having a tube width of 0.850 inches.

Figure 8:
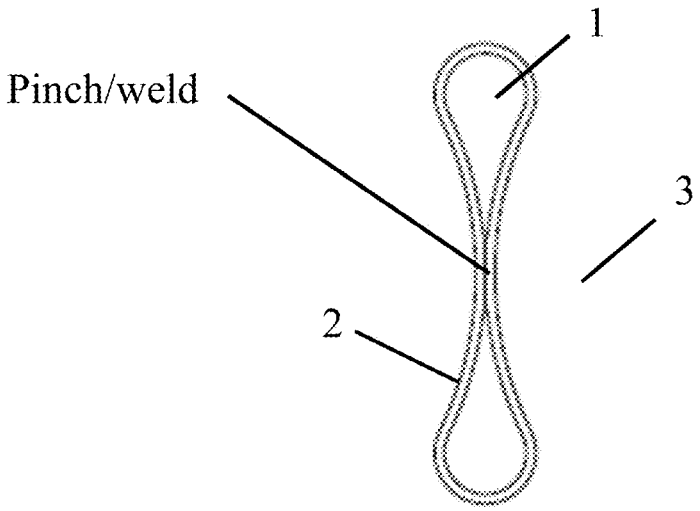
FIG. 8 shows a cross-sectional view of a 2-lobed or "peanut"-shaped heat exchange tube according to an embodiment of the invention.
Figure 9:
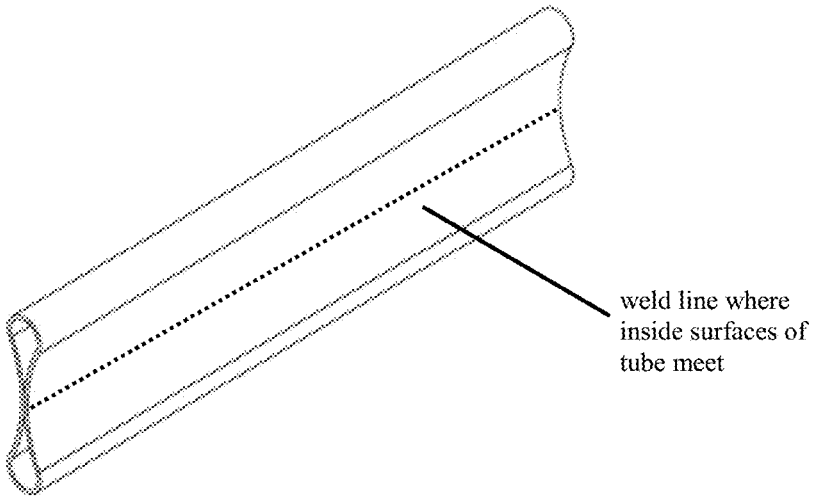
FIG. 9 shows an outside perspective view of a 2-lobed or "peanut"-shaped heat exchange tube according to an embodiment of the invention.

FIGS. 8 and 9 show two-lobed "peanut"-shaped tubes according to an embodiment of the invention. As with prior art tubes, working fluid such as water, glycol, or ammonia 1 is contained within the tube wall 2. Water droplet-filled air 3 flows around the tube from bottom to top. According to a preferred embodiment, the tube height is 1.790 inches, the tube width at the widest cross-section of each lobe is 0.375 inches. However, these dimensions should not be deemed to limit the invention, as multi-lobed tubes of any dimensions may be used according to the invention, including tube heights of 1.250 to 2.500 inches with lobe cross sections of 0.200 to 0.500 inches. The cross-sectional shape of the lobes may be range from teardrop to nearly circular to circular. According to a preferred embodiment opposing inside surfaces of the tubes are welded together at the pinch, i.e., where the inside tube surfaces meet (roughly at the center of the tube in the case of two-lobed tubes). According to various embodiments, the tubes may be finless or finned. Tube wall width is preferably 0.055 inches, but can range from 0.005 inches to 0.06 or greater. In any event, embodiments of the invention can withstand working pressures of 300 psi to 400 psi and beyond.

Figure 10:
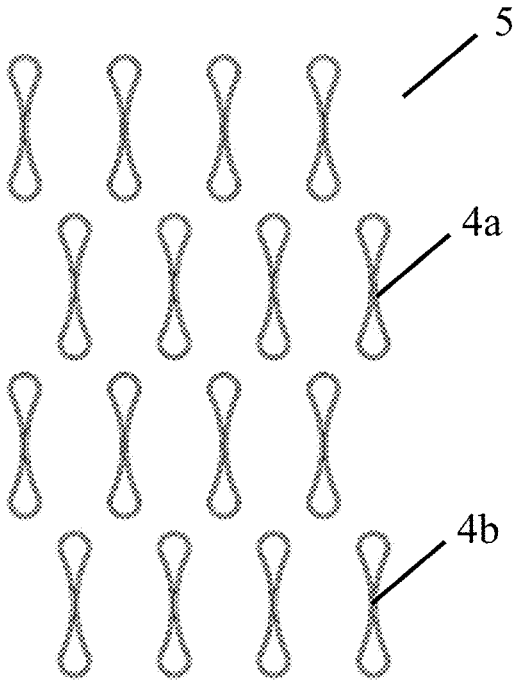
FIG. 10 is a representation of a cross-sectional view of an evaporative heat exchanger tube bundle having 2-lobed or "peanut"-shaped heat exchange tubes according to an embodiment of the invention.
Figure 11A:
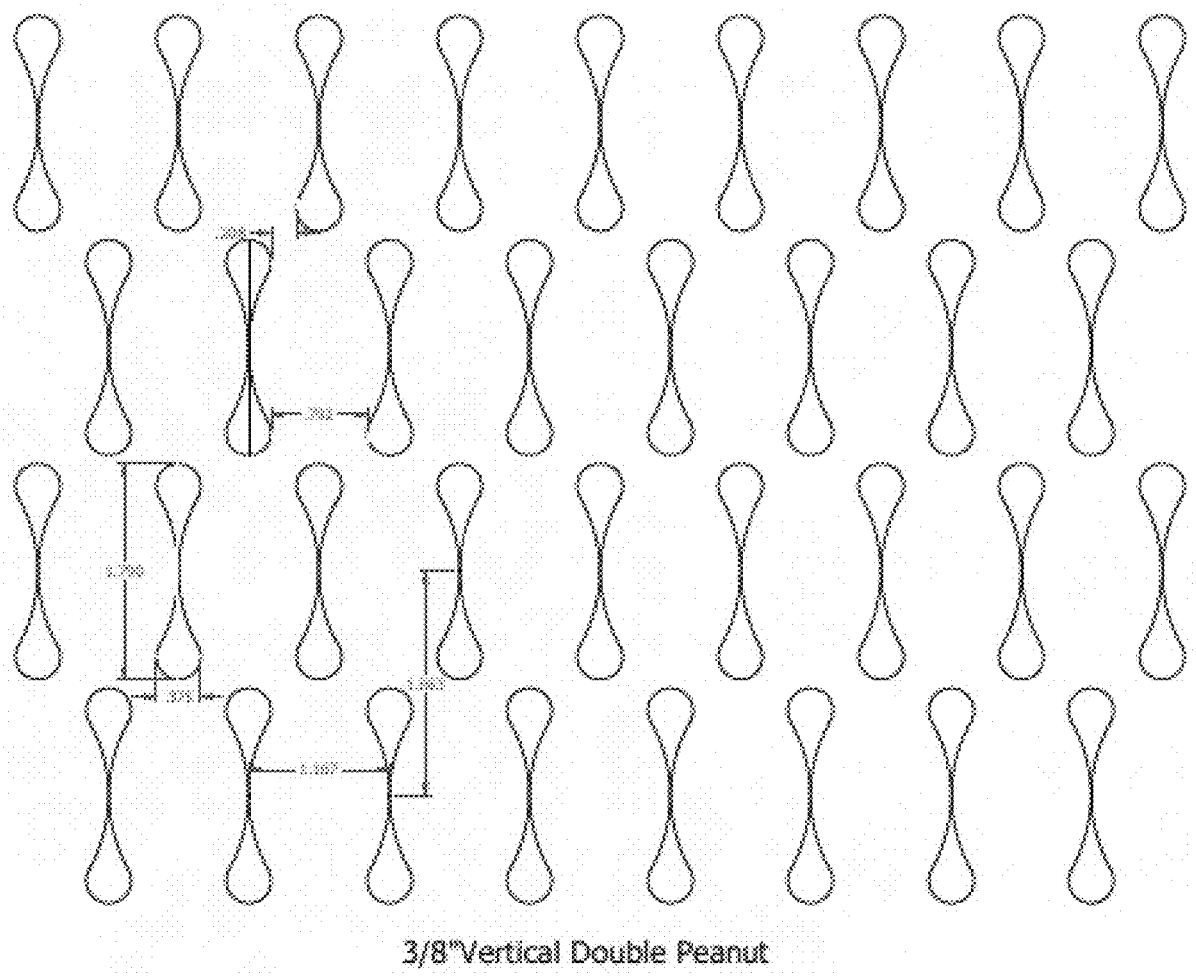
FIG. 11*a* is another representation of a cross-sectional view of an evaporative heat exchanger tube bundle having 2-lobed or "peanut"-shaped heat exchange tubes according to an embodiment of the invention.
Figure 11B:
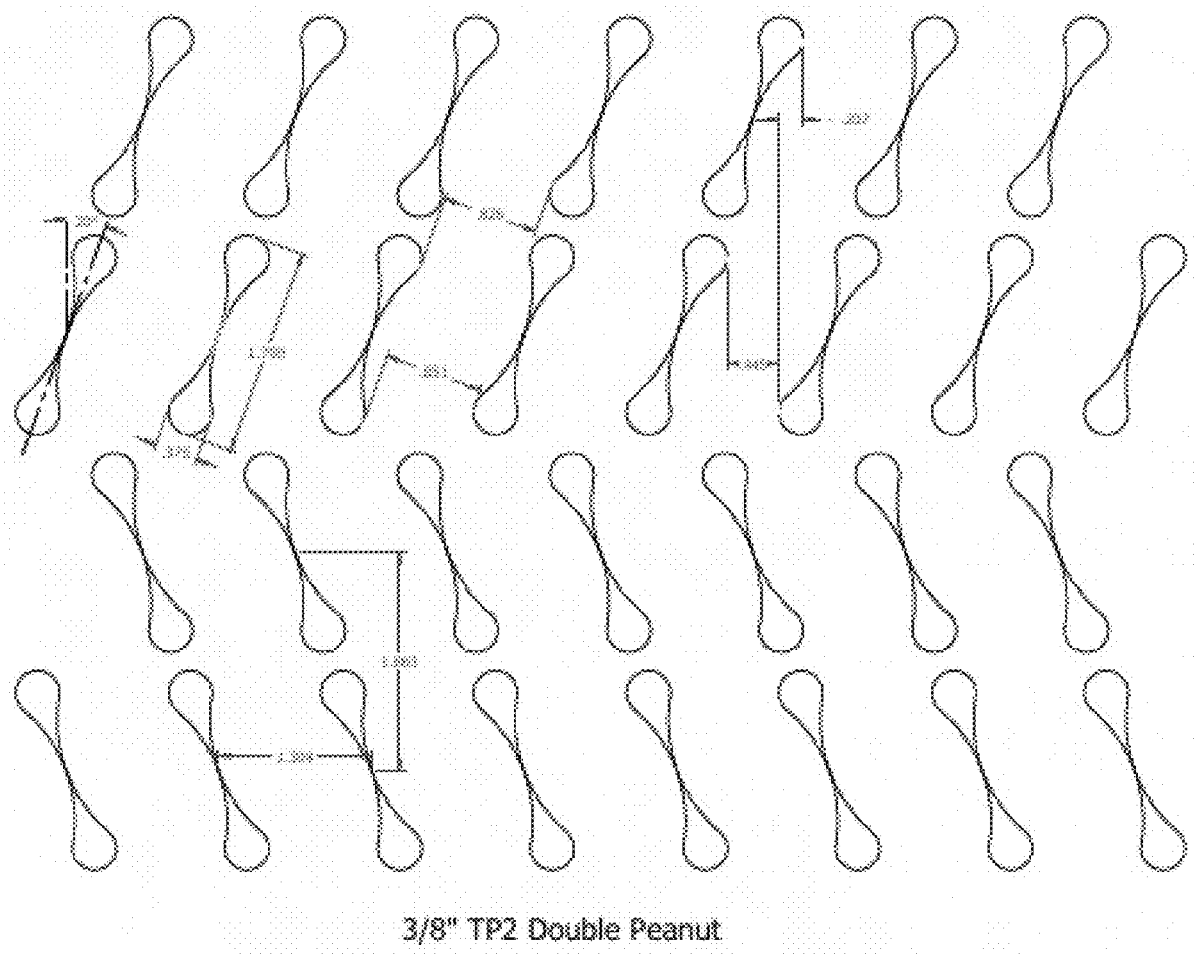
FIG. 11*b* is another representation of a cross-sectional view of an evaporative heat exchanger tube bundle having 2-lobed or "peanut"-shaped heat exchange tubes according to an embodiment of the invention.

FIGS. 10, 11*a* and 11*b* show cross-sectional views of evaporative heat exchanger tube bundles including an arrangement of 2-lobed or "peanut"-shaped tubes of FIGS. 8 and 9. According to this embodiment, the tube bundle has twice the prime external tube surface area of a conventional heat exchanger tube bundle (1.05 inch round tubes or 0.85 elliptical tubes) of the same volume (i.e., coil volume, that is, the volume defined by the outer dimensions of the coil, L×W×H). Multiple tubes 4*a,* 4*b,* etc., are arranged according to the pattern shown to allow water droplet-filled air 5 to pass around the tubes. According to a preferred embodiment, spacing between vertically adjacent rows of tubes (measured center to center) is 102%-106% of the tube height, more preferably 104% of the tube height. Preferred spacing between horizontally adjacent tubes (measured center to center) is 305% to 320% of the lobe width, more preferably 310% to 312% and most preferably 311%.

Figure 12:
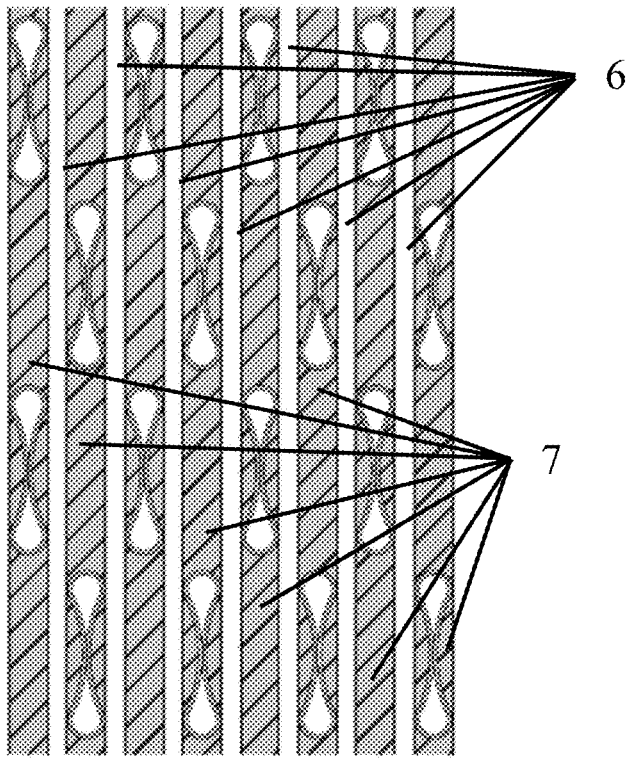
FIG. 12 shows a graphical representation of the open air face area to tube face area for an evaporative heat exchanger tube bundle having 2-lobed or "peanut"-shaped heat exchange tubes according to an embodiment of the invention.

FIG. 12 shows graphical representation of the open air face area 6 to tube face area 7 for a "peanut" unit evaporative heat exchanger tube bundle of the present invention. The open air face area is nearly the same as for a prior art heat exchange coil of the same volume so that the same amount of air can flow through the coil without changing the fan size or power. However, a coil according to the present invention with two-lobed or "peanut" shaped tubes has twice the prime external tube surface area of a conventional evaporative heat exchanger tube bundle of the same volume.

Figure 13:
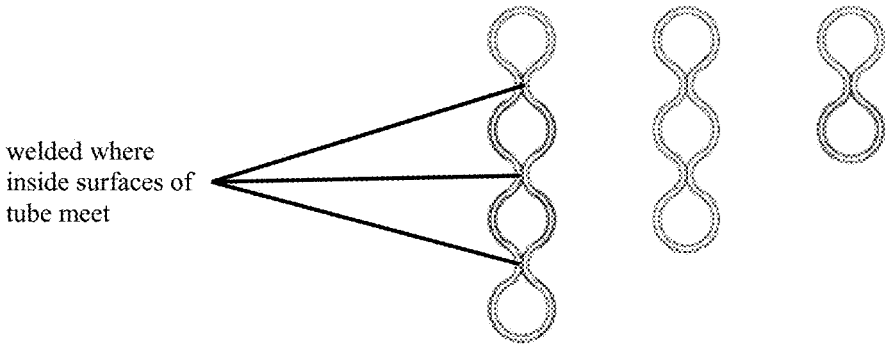
FIG. 13 shows several multi-tube heat exchange tube unit and "peanut"-type tube configurations according to further alternate embodiments of the invention.

FIG. 13 shows additional multi-lobe tube embodiments. According to various embodiments, the lobed-tubes may have 2, 3, 4 or more lobes. And the longitudinal axis of the tube cross-section may be tilted from 0 to 25 degrees from vertical.

Figure 14:
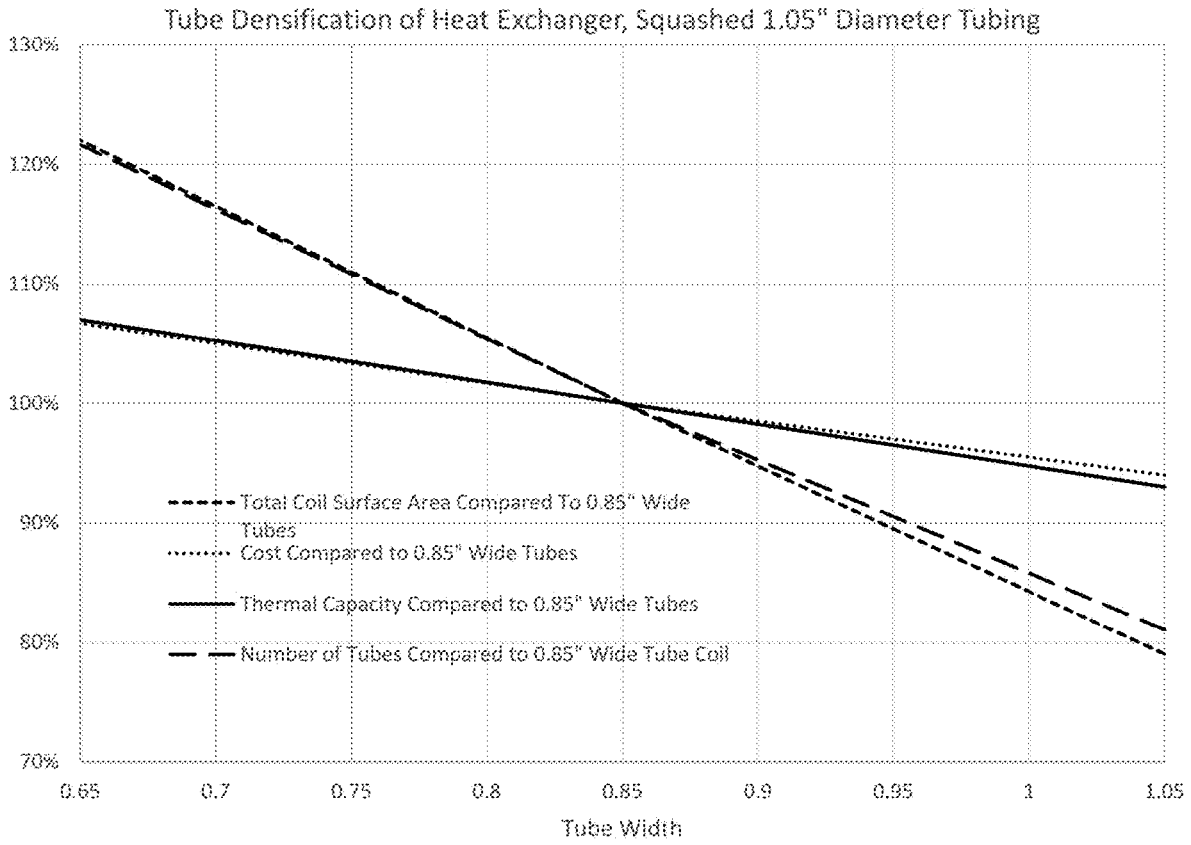
FIG. 14 shows the effect of densifying a coil by using narrower tubes of the same diameter and thickness.

FIG. 14 shows the effect of densifying a coil by using progressively narrower or "squashed" tubes of the same diameter and thickness, i.e., starting with round tubes of 1.05 inch diameter (farthest-right points on the chart), the total coil surface area, the cost, the thermal capacity and the number of tubes was examined for a tube coil having the same volume/outside dimensions. The bottom axis reflects decreasing tube width, from right to left, as 1.05 inch tubes having tube wall thickness of 0.055 inches are squashed into increasingly elliptical tubes. The left axis shows the percentage coil surface, cost, thermal capacity or number of tubes, relative to a coil containing standard elliptical tubes having a width of 0.85 inches. This chart shows that Cost is directly proportional to the thermal capacity. What is not reflected in this chart is that the working pressure limit of the coils decreases dramatically as the tube is squashed more and more, see FIG. 15.

Figure 15:
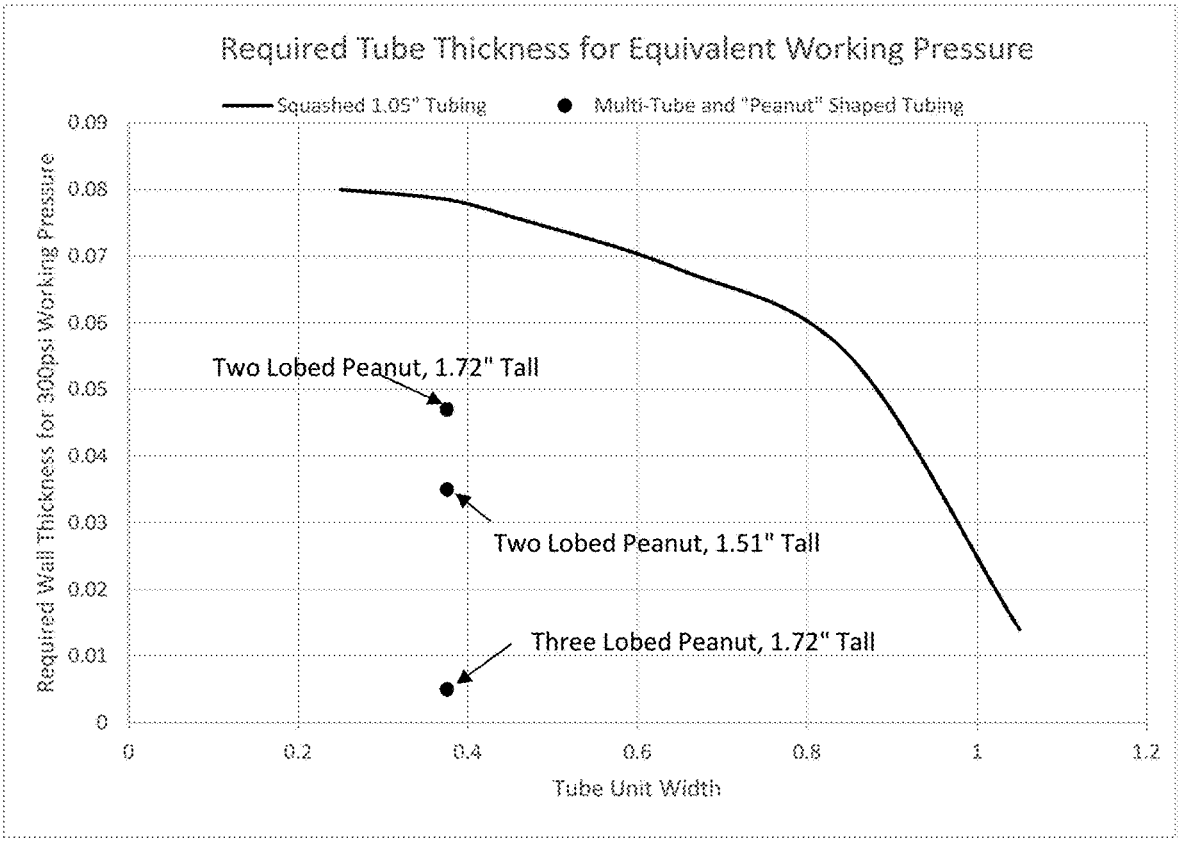
FIG. 15 shows the relationship between tube width and required steel tube thickness for equivalent working pressure for round and "squashed" 1.05" diameter tubes versus "peanut" shaped tubes with 25% more external surface area.

FIG. 15 shows the relationship between tube unit profile width and required steel tube thickness for equivalent working pressure for round and "squashed" 1.05" diameter tubes versus "peanut" shaped tubes with 25% more external surface area. The bottom axis shows tube width, starting on the far right 1.2 inches. The left axis shows the required tube wall thickness for safe operation at 300 psi working pressure. The line that extends from the bottom right quadrant of the chart to the top left shows how the tube thickness required for operation at 300 psi goes from approximately 0.015 inches for a round 1.05 inch tube, to approximately 0.055 6inches for an elliptical tube squashed from 1.05 inches to 0.85 inches, to approximately 0.080 inches for an elliptical tube squashed from 1.05 inches to 0.25 inches. In short, this line shows that as a 1.05 inch tube is squashed (in order for example to fit more tubes in a coil), the thickness of the tube wall necessary to maintain working pressure of 300 psi increases dramatically, thus increasing weight, and material and manufacturing costs. However, FIG. 15 also shows, surprisingly, that two and three-lobed peanut shaped tubes of the present invention have unexpectedly and significantly lower tube wall thickness requirements in order to operate at 300 psi working pressure. For example, a two-lobed tube having a height of 1.72 inches requires a tube wall thickness of only 0.048 inches, which is less than the 0.055 tube wall thickness of prior art 0.85 elliptical tubes. A two-lobed tube having a height of 1.51 inches requires a tube wall thickness of only 0.036 inches for safe operation at 300 psi working pressure, and a three-lobed tube 1.72 inches in height requires a tube wall thickness of only 0.005 inches to operate safely at 300 psi working pressure.

The invention claimed is:

1. An evaporative heat exchanger for cooling or condensing a process fluid, comprising:

an indirect heat exchange section;

a water distribution system located above the indirect heat exchange section and configured to spray water over the indirect heat exchange section;

the indirect heat exchange section comprising a process fluid inlet header and a process fluid outlet header, and an array of multi-lobed tubes connecting said inlet header and said outlet header;

a plenum where water distributed by said water distribution system and having received heat from said indirect section is cooled by direct contact with air moving through said plenum;

a water recirculation system, including pump and pipes, configured to take water collecting at the bottom of said plenum and deliver said water collecting at the bottom of said plenum to said water distribution system;

an air mover configured to move ambient air into said plenum and up through said indirect section, wherein lobes of said multi-lobed tubes are separated from one-another by a pinch weld where opposing inside tube surfaces meet.

2. The device according to claim 1, wherein the multi-lobed tubes have exactly two lobes.

3. The device according to claim 1, wherein the major axis of the multi-lobed tubes is tilted 0 to 25 degrees relative to vertical.

4. The device according to claim 1, wherein the plenum contains fill.

5. The device according to claim 1, wherein said tubes are finned.

6. The device according to claim 1, said tubes having tube heights of 1.250 to 2.500 inches with lobe widths sections of 0.200 to 0.500 inches and tube wall width from 0.005 inches to 0.055 and wherein said tubes can withstand working pressures of 300 psi.

7. The device according to claim 1, said tubes having tube heights of 1.790 inches, a tube width at a widest cross-section of each lobe of 0.375 inches, and a tube wall width of 0.055 inches, and wherein said tubes can withstand working pressures of 300 psi.

* * * * *